US005984723A

United States Patent [19]

Wild

[11] Patent Number: 5,984,723

[45] Date of Patent: Nov. 16, 1999

[54] CONNECTOR FOR COAXIAL CABLE

[75] Inventor: Werner Wild, Buttenwiesen-Unterthürheim, Germany

[73] Assignee: Spinner GmbH Elektrtechnische Fabrik, Munich, Germany

[21] Appl. No.: 08/928,736

[22] Filed: Sep. 12, 1997

[30] Foreign Application Priority Data

Sep. 14, 1996 [DE] Germany ..... 196 37 971

[51] Int. Cl.[6] ..... H01R 9/05

[52] U.S. Cl. ..... 439/583; 439/585

[58] Field of Search ..... 439/578, 579, 439/580, 581, 582, 583, 584, 585, 840–1

[56] References Cited

U.S. PATENT DOCUMENTS 4,046,451 9/1977 Juds et al. ..... 174/21 C
5,772,855 3/1998 Kanda et al. ..... 439/578
5,871,372 2/1999 Kanda et al. ..... 439/583

*Primary Examiner*—Lincoln Donovan
*Attorney, Agent, or Firm*—Henry M. Feiereisen

[57] ABSTRACT

A connector assembly for a coaxial cable with a corrugated outer conductor, includes a housing being so configured as to define a recess at formation of an annular surface for contacting an inner end face of the outer conductor, and a clamp mechanism for captivating one end of the coaxial cable. The clamp mechanism includes a corrugated sleeve adapted to fit over the cable outer conductor, with the end face of the cable outer conductor projecting axially beyond an end face of the corrugated sleeve, and a clamping member adapted for engagement with the housing and thereby so pushing the corrugated sleeve into the recess by a distance as to clamp a portion of the end face of the cable outer conductor between the annular surface of the housing and the end face of the corrugated sleeve, with the corrugated sleeve being guided within the recess for axial displacement and secured therein against rotation.

10 Claims, 1 Drawing Sheet

CONNECTOR FOR COAXIAL CABLE

BACKGROUND OF THE INVENTION

The present invention generally relates to a connector for coaxial cables with corrugated outer conductor.

German Pat. No. 43 44 328 C 1 describes a connector for a coaxial cable with a corrugated outer conductor, including a connector housing (typically called "connector head") which is formed with a recess for receiving the cable end such that an annular surface at the connector-proximate region is able to make electric contact with the inner end face of the outer cable conductor. The cable end is captivated by a clamp mechanism in the form of a corrugated sleeve which surrounds the outer cable conductor, and a clamping member adapted for engagement with the housing to push the corrugated sleeve during clamping action into the recess so that the connector-proximate end portion of the outer conductor of the cable, which end portion projects beyond the corrugated sleeve, is clamped between the annular surface in the recess of the housing and the end face of the corrugated sleeve.

Such connector assemblies are intended for coaxial cables with a helically corrugated outer conductor and are generally supplied from the factory completely preassembled in order to prevent damage to the components during storage and transport. The connector, however, has to be dismantled for assembly, because it is usually necessary to first screw or push the clamping member, typically in the form of a sleeve, over the properly prepared cable. Subsequently the corrugated sleeve is added and finally the connector housing, whereby the outer conductor has to project beyond the end face of the corrugated sleeve by a predetermined distance for ensuring a proper clamping of the protruding section of the outer conductor during the final clamping action of the sleeve with the connector housing, thereby guaranteeing a secure contact and grip. A dismantling of the connector before attachment to the cable is disadvantageous for several reasons because components may fall off, get lost or a mix up between components may occur. Moreover, manipulation of several components and recheck of the demanded distance of the outer conductor beyond the corrugated sleeve are time-consuming and bothersome, in particular at unprotected installation sites. Consequently, there remains a certain unacceptable risk for errors during assembly.

SUMMARY OF THE INVENTION

It is therefore an object of the present invention to provide an improved connector assembly, obviating the afore-stated drawbacks.

In particular, it is an object of the present invention to provide an improved connector assembly which can be rapidly and easily attached to the cable quickly in a reliable manner.

These objects, and others which will become apparent hereinafter, are attained in accordance with the present invention by providing a connector housing being so configured as to define a recess at formation of an annular surface for contacting an inner end face of the outer conductor, and a clamping unit for captivating one end of the coaxial cable, with the clamping unit including a corrugated sleeve adapted to fit over the outer conductor whereby the end face of the cable outer conductor projects axially beyond an end face of the corrugated sleeve, and a clamping member adapted for engagement with the housing and thereby so pushing the corrugated sleeve into the recess by a distance as to clamp a portion of the end face of the cable outer conductor between the annular surface of the housing and the end face of the corrugated sleeve, with the corrugated sleeve being guided within the recess for axial displacement and secured therein against rotation.

By simply proposing to guide the corrugated sleeve within the recess in a non-rotatable manner for axial displacement, the necessity for dismantling the connector before installation is eliminated since the connector can now be shipped in a preassembled state, with the clamping member assuming relative to the connector housing a position which is defined in such a way that the remaining axial clamping distance is identical to the displacement distance required for clamping the cable outer conductor. The so preassembled connector is subsequently screwed onto the appropriately prepared cable end until a noticeable resistance is encountered. The resistance is caused by the end face of the cable outer conductor when impacting the annular surface in the connector housing. The non-rotatable guidance of the corrugated sleeve in the recess of the connector housing guarantees that the corrugated sleeve is in its proper position during this installation step, i.e. the corrugated sleeve impacts upon the cable-proximate end of the clamping member, since the sleeve is inevitably pulled into this position when the connector is screwed onto the cable. The assembler is then only required to tighten the clamping member to the connector housing (typically by threadable engagement) until a specified clamping torque is reached, indicating that the desired clamping of the cable outer conductor has been accomplished. Consequently, no additional visual checks or measurements are required during assembly.

Advantageously, the non-rotatable axial guidance is effected by a complementary contour, such as a keyway on the inner surface of the recess and a complimentary profile, such as a projection, on the outer surface of the corrugated sleeve.

According to another feature of the present invention, the connector is provided with a preassembly indexing mechanism which so subdivides the clamping distance of the clamping member into two segments that the position of the clamping member at the transition from the first segment to the second segment is the same as for the connector in its preassembled state. As a result, the connector does no longer have to be supplied from the factory with the clamping member in a predetermined position relative to the connector housing. Moreover, if required, the user may even dismantle the preassembled connector before attachment to the cable, and can subsequently restore the preassembled condition.

Advantageously, the preassembly indexing mechanism may simply be formed by a marking which indicates to the user the position of the clamping member at the end of the first clamping segment. The mechanism can also be designed in such a way that the torque required for securing the clamping member to the connector housing increases noticeably when the end of the first clamping segment is reached.

More particularly, the preassembly indexing mechanism may include an O-ring disposed between the connector housing and the clamping member at the end of the first clamping segment. In addition, or alternatively, the mechanism can also be effected by a material deformation located at the end of the first clamping segment between components movable relative to one another.

Suitably, the corrugated sleeve can be of split configuration or designed as a corrugated nut. The clamping member may preferably be formed by a threaded coupling ring.

According to another preferred embodiment of the invention, the annular surface in the recess of the connector housing and the end face of the corrugated sleeve can be located in respective radial planes for clamping the end portion of the cable outer conductor between these surfaces in a flange-type manner.

It is still another object of the invention to provide an improved method for mounting a connector assembly to a coaxial cable in a simple and reliable manner.

This object is attained by initially preassembling the connector in such a way that the end face of the corrugated sleeve on the connector-proximate side is placed at a specified distance from the bottom of the recess in the connector housing, by mounting this preassembled connector to the cable end in such a way that the end face of the outer conductor of the cable contacts the clamping surface of the recess, and by firmly bracing together the clamping member and the connector housing.

Suitably, the bracing step is so executed that the connector housing is held stationary while the clamping member is tightened because this ensures that a relative rotation between the end face of the (cable) outer conductor and the contact-forming annular surface of the connector housing is prevented, which could otherwise damage the typically silver-plated contact surface and deteriorate the quality of the contact.

BRIEF DESCRIPTION OF THE DRAWING

The above and other objects, features and advantages of the present invention will now be described in more detail with reference to the accompanying drawing, in which.

DESCRIPTION OF PREFERRED EMBODIMENTS

Figure 1:
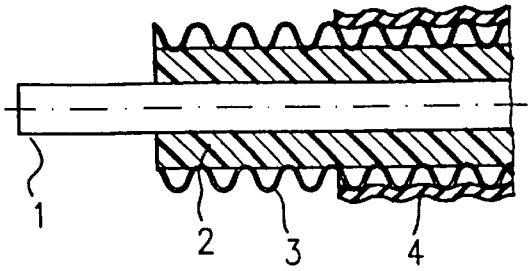
FIG. 1 is a sectional view through an end of a coaxial cable prepared for assembly with a helically corrugated outer conductor.

Throughout all the Figures, the same or corresponding elements are always indicated by the same reference numerals.

Turning now to the drawing, and in particular to FIG. 1, there is shown a conventional coaxial cable of a type having an inner conductor 1 which is centered in and supported by a dielectric spacer 2. Surrounding the dielectric spacer 2 is a helically corrugated outer conductor 3 which is enclosed by a cable jacket 4 that is shortened or set back by a specified length in dependence on the connector design, so that a bare section of the outer conductor 3 projects beyond the cable jacket 4 by the predetermined length. The outer conductor 3 including the dielectric spacer 2 are also set back relative to the inner conductor 1 by a predetermined distance.

Figure 2:
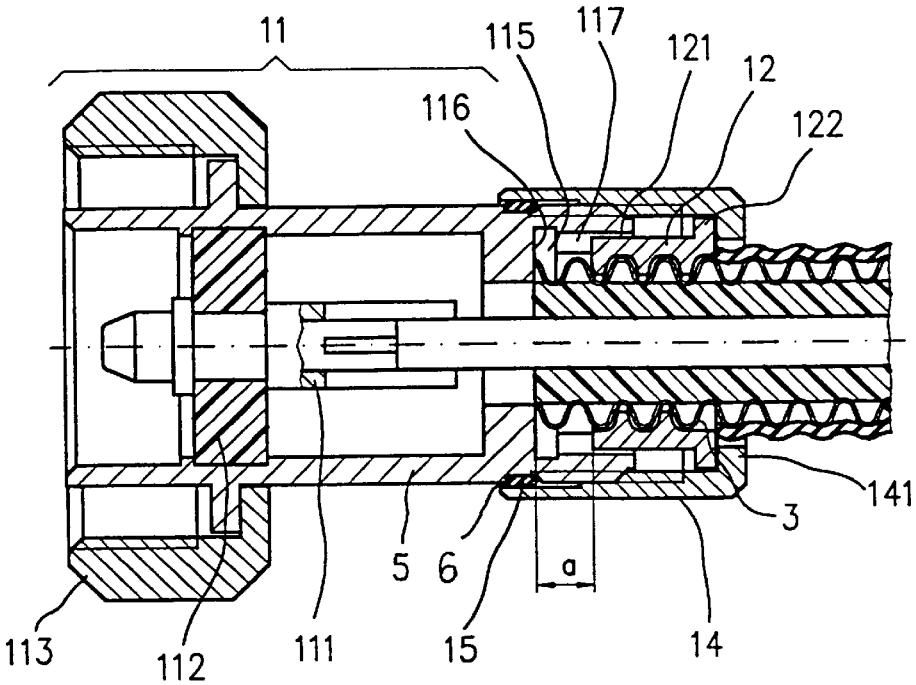
FIG. 2 is a longitudinal section of one embodiment of a connector assembly according to the present invention in its preassembled position.

Referring now to FIG. 2, there is shown a longitudinal section of one embodiment of a connector head assembly according to the present invention in its preassembled position. The connector includes a connector head, denoted in its entirety by reference numeral 11, which includes an inner conductor 111 held by an insulating washer 112 within a connector housing 5, and a coupling nut 113 for attachment of a complementary connector which is not shown in detail for sake of simplicity as it does not form part of the present invention.

At the cable-side end of the connector head 11, the connector housing 5 is formed with a recess 115 which is bounded at the connector-side end by an annular surface 116 oriented in a radial plane and forming the contact surface for the outer conductor 3.

For making electric contact as well as for mechanically capturing the cable, the connector includes a corrugated sleeve 12 which in the depicted preassembled position, shown in FIG. 2, is partly received in the recess 115. The corrugated sleeve 12 is guided in axial direction in the recess 115 and secured against rotation through provision of at least one axial rib 121 which engages a complementary axial groove 117 of the connector housing 5.

On the cable-proximate side, the corrugated sleeve 12 terminates in an annular flange 122 which bears upon a cable-proximate annular collar 141 of a threaded retainer sleeve 14. The retainer sleeve 14 is screwed onto an external thread on the cable-side end of the connector housing 5 to such an extent that between the connector-proximate end face of the corrugated sleeve 12 and the annular surface 116 in the recess 115 a distance, denoted by reference character a, remains which represents the actual clamping path.

The connector is supplied in the preassembled state depicted in FIG. 2, without the cable. In order for this preassembled state, in which the retainer sleeve 14 is so threaded onto the connector housing 5 as to maintain the required clamping distance, to be defined and reproducible even in the unlikely event an assembler unnecessarily dismantles the connector before final installation, a preassembly indexing device is provided by which the clamping distance of the corrugated sleeve 12 is subdivided into two segments, with the first segment corresponding to the preassembled state of the connector, and the second segment corresponding to the distance a representing the actual clamping path during the final mounting upon the cable.

In accordance with a preferred embodiment, the indexing device is constituted by an O-ring 15 which is disposed in an annular groove 6 of the connector housing 5, with the groove 6 being so situated that the end face of the retainer sleeve 14 just about extends over the O-ring when, as shown in FIG. 2, the required distance a is effectuated between the end face of the corrugated sleeve 12 and the annular surface 116. As a result, the sleeve 14 can be threaded in an initial phase onto the connector housing 5 at very little resistance, until the end face reaches the O-ring 15. At this point, an increased resistance is noticed upon further tightening of the sleeve 14, indicating that the correct preassembled state of the connector has been attained.

Persons skilled in the art will understand that the same purpose can be achieved by employing other devices, e.g. a suitable indentation or different material deformation at an appropriate location. Other measures corresponding to the function of the O-ring 15 can also be envisioned between the connector housing 5 and the corrugated sleeve 12. In the simplest case, it would be sufficient to provide the connector housing 5 with an optical marker at a location which corresponds to the position of the end face of the sleeve 14 in the preassembled state.

In the preassembled state, the connector is screwed onto the cable until the end face of the outer conductor 3 abuts against the annular surface 116 of the connector housing 5, as indicated by a noticeably increased resistance. The length of the bare portion of the outer conductor 3 and the axial length of the corrugated sleeve 12 are thereby so matched to one another that about two free screw turns of the outer conductor 3 are effected between the annular surface 116 and the end face of the corrugated sleeve 12. Even if the corrugated nut 12 occupies prior to attachment of the connector onto the cable an intermediate position between the annular surface 116 of the connector housing 5 and the annular collar 141 of the sleeve 14, the corrugated sleeve 12 is guaranteed to assume the initial position depicted in FIG. 2 after attachment of the connector onto the cable is completed, since the screw motion will necessarily force the corrugated sleeve 12 in the direction of the cable as a consequence of the non-rotatable axial guidance of the corrugated sleeve 12 until the cable-proximate annular flange 122 of the corrugated sleeve 12 bears upon the annular collar 141 of the sleeve 14.

The final assembly is effected by screwing the retainer sleeve 14 about the distance a onto the connector housing 5. In order to prevent damage to the typically silver-plated contact coat on the annular surface 116 of the connector housing 5 and thereby a degradation of the contact quality, the connector head 11 is suitably held stationary and the retainer sleeve 14 is turned. Although not shown in detail, it may also be suitable for reducing friction to provide a sliding ring between the annular collar 141 of the retainer sleeve 14 and the cable-proximate annular flange 122 of the corrugated sleeve 12.

Figure 3:
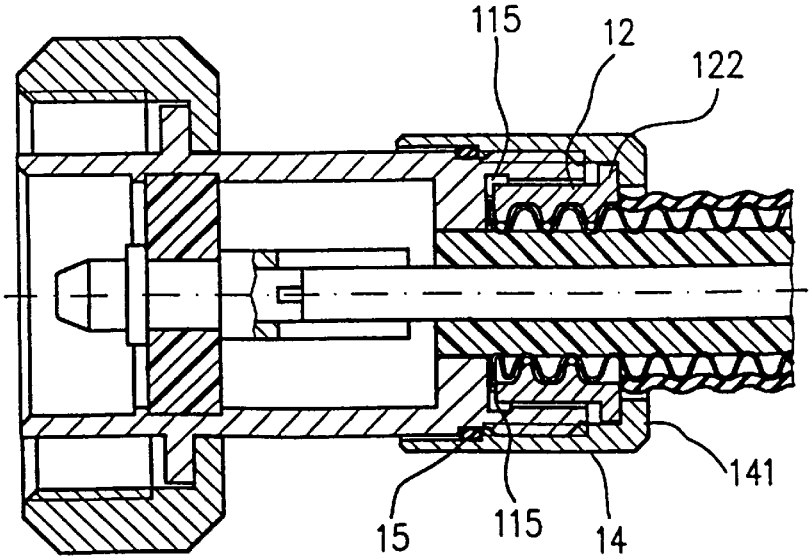
FIG. 3 is a longitudinal section of the connector assembly and the cable after completed installation.

After assembly is concluded, the connector-proximate section of the outer conductor 3 of the cable, projecting beyond the corrugated sleeve 12, is so deformed as to exhibit a flange-like configuration, as illustrated in FIG. 3, and clamped between the annular surface 116 and the connector-proximate end face of the corrugated sleeve 12.

While the invention has been illustrated and described as embodied in a connector for a coaxial cable, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A cable-ready connector arrangement for attachment onto a coaxial cable with a corrugated outer conductor, comprising:

a connector housing having a recess and defining an annular surface for contacting an inner end face of the cable outer conductor; and clamping means for captivating one end of the coaxial cable, said clamping means including a corrugated sleeve adapted to fit over the cable outer conductor, with the inner end face of the cable outer conductor projecting axially beyond an end face of the corrugated sleeve, and a clamping member connectable to the housing, for pushing the corrugated sleeve into the recess until a portion of the inner end face of the cable outer conductor is clamped between the annular surface of the housing and the end face of the corrugated sleeve, said corrugated sleeve being arranged in fixed rotative engagement with the connector housing and displaceable in axial direction within the recess relative to the connector housing by the clamping member during attachment of the connector arrangement onto the coaxial cable.

2. The connector arrangement of claim 1 wherein the housing has an inner surface area and the corrugated sleeve has an outer surface area, said inner and outer surface areas complementing each other to effect the guidance for axial displacement of the corrugated sleeve with respect to the housing in a non-rotatable manner.

3. The connector arrangement of claim 1, and further comprising indexing means for subdividing a travel path of the corrugated sleeve within the recess into first and second segments, with the first segment corresponding to a preassembled state of the connector assembly, and with the second segment corresponding to a final assembly of the connector assembly onto the cable end.

4. The connector arrangement of claim 3 wherein the preassembly indexing means includes a marking for designating a position of the clamping member upon reaching the end of the first segment.

5. The connector arrangement of claim 3 wherein the preassembly indexing means noticeably increases the torque required for tightening the clamping member with the housing at the end of the first segment.

6. The connector arrangement of claim 3 wherein the indexing means includes an O-ring disposed between the housing and the clamping member and providing a tactile response at the end of the first segment.

7. The connector arrangement of claim 3 wherein the indexing means includes a material deformation providing a tactile response, said indexing means being disposed at the end of the first segment between at least two elements movable relative to one another and selected from the group consisting of the housing, the corrugated sleeve and the clamping member.

8. The connector arrangement of claim 3 wherein the corrugated sleeve is a corrugated nut.

9. The connector arrangement of claim 1 wherein the clamping member is a threaded retainer sleeve.

10. The connector arrangement of claim 1 wherein the annular surface bounding the recess in the housing and the end face of the corrugated sleeve are located in radial planes for clamping the end portion of the outer conductor in a flange-like manner between the annular surface and the end face of the corrugated sleeve.

* * * * *